US005386966A

United States Patent [19]

Gosch

[11] Patent Number: 5,386,966

[45] Date of Patent: Feb. 7, 1995

[54] ROTARY SLIDE VALVE FOR METALLURGICAL VESSELS

[75] Inventor: Rolf Gosch, Thalheim Bei Wels, Austria

[73] Assignee: EB Bruhl Aluminiumtechnik GmbH, Brühl, Germany

[21] Appl. No.: 197,382

[22] Filed: Feb. 15, 1994

[30] Foreign Application Priority Data

Feb. 16, 1993 [DE] Germany ..... 4304621

[51] Int. Cl.[6] ..... F16K 5/00

[52] U.S. Cl. ..... 251/304; 251/290

[58] Field of Search ..... 251/290, 304, 142

[56] References Cited

U.S. PATENT DOCUMENTS 3,511,471 5/1970 Rossi ..... 251/304 X
4,554,948 11/1985 Bergmann ..... 251/304

FOREIGN PATENT DOCUMENTS 0234877 9/1987 European Pat. Off. .
3223181 12/1983 Germany .
4012093 7/1991 Germany .
374454 2/1964 Switzerland .

*Primary Examiner*—John C. Fox
*Attorney, Agent, or Firm*—Darby & Darby

[57] ABSTRACT

A rotary slide valve for controlling the flow of molten material from a discharge opening of a holding vessel into an inlet of a rotatable casting mold has three valve plates which are in face-to-face contact. A first valve plate at the inflow side of the valve is fixed and is designed to abut the holding vessel peripherally of its discharge opening. A second valve plate at the discharge side of the valve is designed to engage the mold peripherally of the mold inlet and to rotate with the mold between two terminal positions. The third valve plate is sandwiched between the others and can be driven in rotation relative to both. Each of the valve plates is provided with a through opening. The valve is designed so that, at least in the two terminal positions of the discharge valve plate, the openings of all the valve plates can be brought into register and the openings of two of the valve plates can be brought out of register.

18 Claims, 9 Drawing Sheets

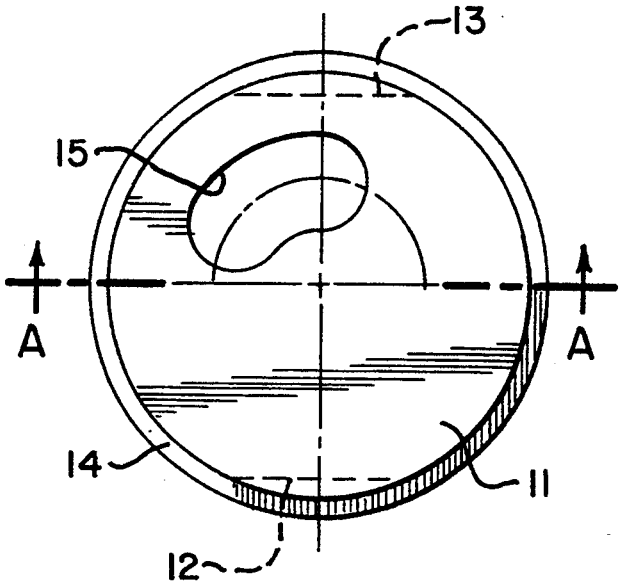
FIG. 1a
FIG. 1b
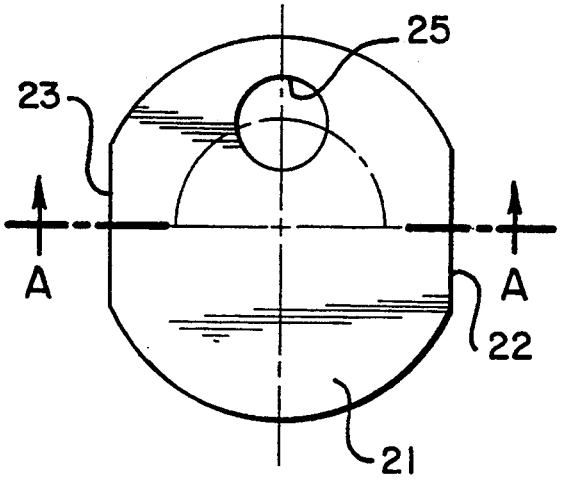
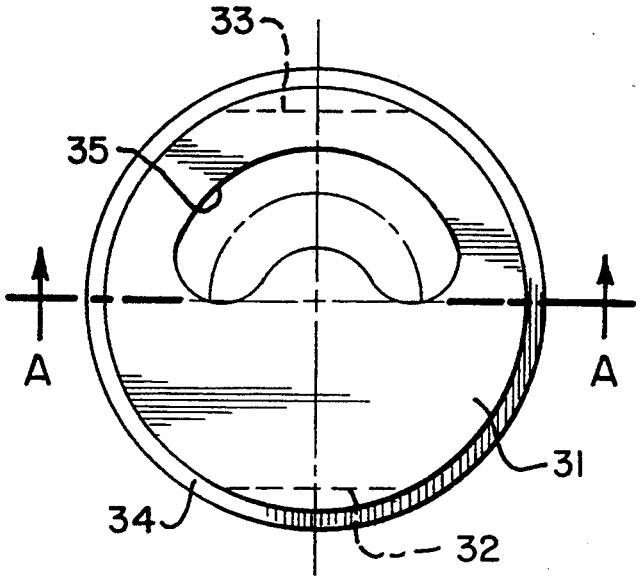
FIG. 1c

ROTARY SLIDE VALVE FOR METALLURGICAL VESSELS

FIELD OF THE INVENTION

The invention relates to a slide valve.

BACKGROUND OF THE INVENTION

Slide valves serving as discharge valves for metallurgical vessels are disclosed in the German publication 32 23 181 A1 and the German publication 40 12 093 C1. These slide valves include a plate which generally consists of ceramic and is shiftable in its own plane. The plate has a through opening which, by displacement of the plate, can be brought into register with the discharge opening of a vessel containing a melt. When the axis of the discharge opening is vertical, the plate lies, and is shiftable, in a horizontal plane.

The Swiss publication 374 454 teaches a rotary slide valve having a plurality of plates. The plate on the discharge side of the valve is rotatable and the valve is controlled, i.e., opened and closed, by rotating such plate.

The European patent application 0 234 877 A1 discloses a bottom pressure casting process in which a casting mold is filled via a bottom inlet having a horizontal axis. For solidification, the mold is rotated 180 degrees about this axis. The inlet remains open and no provision is made for closing the inlet. The vessel containing the melt for the mold is located below the inlet and, after the mold has been rotated, the pressure is reduced and the inlet empties into the vessel due to gravity.

Should the filling of a mold through a bottom inlet with subsequent rotation of the mold be applied to a gravity casting process where the vessel containing the melt is located above the inlet, a valve must be available to close off the mold from the vessel. If the hydrostatic pressure in the vessel is to be maintained in the mold during solidification, the valve must be able to keep the mold and the vessel in communication without a loss in sealing action.

Valves of the type described above are not suitable for discharge openings having horizontal axes. This is particularly true where a mold directly contacts a valve and the mold is rotated about a horizontal axis after filling of the mold.

SUMMARY OF THE INVENTION

It is an object of the invention to provide a valve which is usable for horizontal flow and can be of simple construction.

Another object of the invention is to provide a valve which is capable of operating with a high degree of reliability even when a vessel in direct contact with the valve is rotated about a horizontal axis.

The preceding objects, as well as others which will become apparent as the description proceeds, are achieved by the invention.

One aspect of the invention resides in a valve, particularly a discharge valve for metallurgical vessels. The valve comprises a plurality of valve elements including two which are shiftable relative to one another. Each of the valve elements has an opening for the passage of fluid therethrough, and a selected one of the valve elements is movable between a first position and a second position. The openings are arranged so that, in each of these positions, the openings of all valve elements can be in register and, alternatively, at least two openings can be out of register.

It is preferred for the two relatively shiftable valve elements to be rotatable relative to one another. These valve elements may be arranged so that rotation of at least one such valve element allows the openings in the valve elements to be brought into or out of register. The valve elements can be mounted in a carrier or housing and the two relatively rotatable valve elements can abut one another. The valve elements may be plate-like and the openings are preferably off-center in the respective valve elements.

The valve may be used to control the discharge of fluid from an outlet of a first vessel into a movable inlet of a second vessel. By way of example, the first vessel can constitute a source of a melt and the second vessel can be a rotatable casting mold. Here, the selected valve element can be rotatable between the first and second positions in at least approximate synchronism with the mold or its inlet. The valve can engage both the melt-containing vessel and the mold and it is preferred for the selected valve element to be located on the discharge side of the valve, that is, on the side of the valve adjacent the mold. The selected valve element will hereinafter also be referred to as the discharge or outflow valve element.

The discharge valve element can be in purely frictional face-to-face contact with the inlet of the mold. However, it is possible to additionally provide mold gripping elements between the abutting surfaces. In either case, rotation of the mold indirectly causes rotation of the discharge valve element. Alternatively, the discharge valve element can be directly rotated by its own drive which operates in synchronism with the mold. The term casting mold as used herein includes extensions, connections and pipe guides which are fixed to the mold.

In operation, the inlet of a mold can be placed against the valve of the invention in such a manner that the inlet lies in a lower region of the mold. The valve is closed, i.e., at least two openings of the valve are out of register, during positioning of the mold in contact with the valve. Once the mold has been properly positioned, the mold is held stationary while at least two of the valve elements are rotated relative to one another in order to bring the valve openings into register and thus open the valve. By means of the valve, the mold cavity is now filled from a melt-containing vessel using a bottom pressure casting procedure. Once the mold has been filled with molten material, the mold is rotated about the axis of the valve, preferably through 180 degrees, with the valve open. Solidification of the molten material in the mold now takes places under the hydrostatic pressure of the melt in the melt-containing vessel. When solidification has progressed sufficiently, the valve is closed by rotating at least two of the valve elements relative to each other. The mold with its largely solidified contents can then be separated from the valve.

The mold can be a self-supporting sand mold and may be placed in direct contact with the discharge valve element.

According to one embodiment of the invention, only one valve element is provided in addition to the discharge valve element. This second valve element, which is adjacent the discharge valve element on the upstream side thereof, is controllably driven in rotation. Regardless of the rotational position of the discharge valve element, the openings of the two valve elements can be selectively brought into and out of register. When the second valve element is rotated, the rotary motion of the discharge valve element must be taken into account. Thus, assuming that the valve is closed, the second valve element can initially be rotated in such a manner that the openings of the two valve elements come into register. If the discharge valve element is now rotated with the mold, the second valve element must be synchronously rotated with the discharge valve element, e.g., through 180 degrees, in order to keep the openings in register. The valve elements may be kept in this position as long as necessary whereupon the valve is closed by rotating the second valve element alone.

The mold can now be removed. To return the valve to its original condition, the two valve elements can be rotated in synchronism back to their starting positions. However, it is not necessary to return the valve elements to their original positions because the absolute positions of the two valve elements are not important and different starting positions upon opening of the valve have no detectable influence on the operation of the valve. On the other hand, the free cross section of the mold inlet should overlie the outer peripheries of the openings in the valve elements in all possible rotational positions of the valve elements.

In this embodiment, the second valve element can be in direct contact with the liquid in the melt-containing vessel, i.e., melt is always present in the opening of the second valve element. The entire circumference of an end face of the second valve element preferably forms a seal around the periphery of the discharge opening of the melt-containing vessel. This discharge opening may be defined by a large through opening of a valve plate.

According to another embodiment of the invention, two valve elements are provided in addition to the discharge valve element. These two valve elements are disposed upstream of the discharge valve element, and one of the two is controllably driven in rotation. Regardless of the rotational position of the discharge valve element, the openings of all the valve elements can be brought into register and the openings of at least the two additional valve elements can be moved out of register. The driven additional valve element is preferably the middle one of the three valve elements. Opening and closing of the valve takes place by relative movement of the two additional valve elements. Assuming that the valve is closed, the two additional valve elements are rotated relative to one another so that their openings come into register and define a flow passage through the additional valve elements. The opening of the discharge valve element is here arranged in such a manner that it registers with the openings in the additional valve elements. When a mold filled via the valve is subsequently rotated, one possibility is to retain the additional valve elements in their positions and to allow only the discharge valve element to rotate with the mold. This requires that the opening of the discharge valve element register with the opening of the neighboring valve element in each rotational position of these two valve elements or that the opening of the discharge valve element extend circumferentially of the latter through a minimum predetermined angle, e.g., 180 degrees. Another possibility is to rotate at least one of the two additional valve elements together with the discharge valve element to thereby maintain opening registry as the mold moves to its rotated position, e.g., a position displaced by 180 degrees from the original position of the mold. Closing of the valve with the mold in its rotated position is again accomplished by rotating the two additional valve elements relative to one another, preferably by rotating the middle valve element with respect to the other of the additional valve elements. At the same time, the openings of the middle valve element and the discharge valve element can also be moved out of register although this is not necessary.

Common to the two embodiments of the invention outlined above is the synchronous rotation of the discharge valve element with the mold. It is preferred for the discharge valve element to be freely rotatable so that it can be carried along by the mold.

The valve elements can be ceramic. They can be directly centered in the carrier by means of their outer peripheries or can be centered relative to each other via shoulders or collars provided on one or more of the valve elements in the regions of such peripheries.

The valve element which is disposed adjacent, and envelopes the discharge opening of, the melt-containing vessel may be fixed in the carrier so as to be non-rotatable. In order to fix this valve element in the carrier or to fix a driven valve element in an externally driven rotary gear, the valve elements may be provided with opposed flats resembling key faces. In this manner, radial stressing with a view to possible temperature-induced dimensional changes can be eliminated. To compensate for thermal expansion and simultaneously establish direct face-to-face contact between the valve elements, it is possible to provide springs, especially plate springs, which stress the valve elements axially with respect to the carrier.

BRIEF DESCRIPTION OF THE DRAWINGS

Additional features and advantages of the invention will be forthcoming from the following detailed description of preferred embodiments when read in conjunction with the accompanying drawings.

FIGS. 1*a*–1*c* are elevational views of respective valve plates constituting part of a valve in accordance with the invention;

DESCRIPTION OF PREFERRED EMBODIMENTS

Figure 2A:
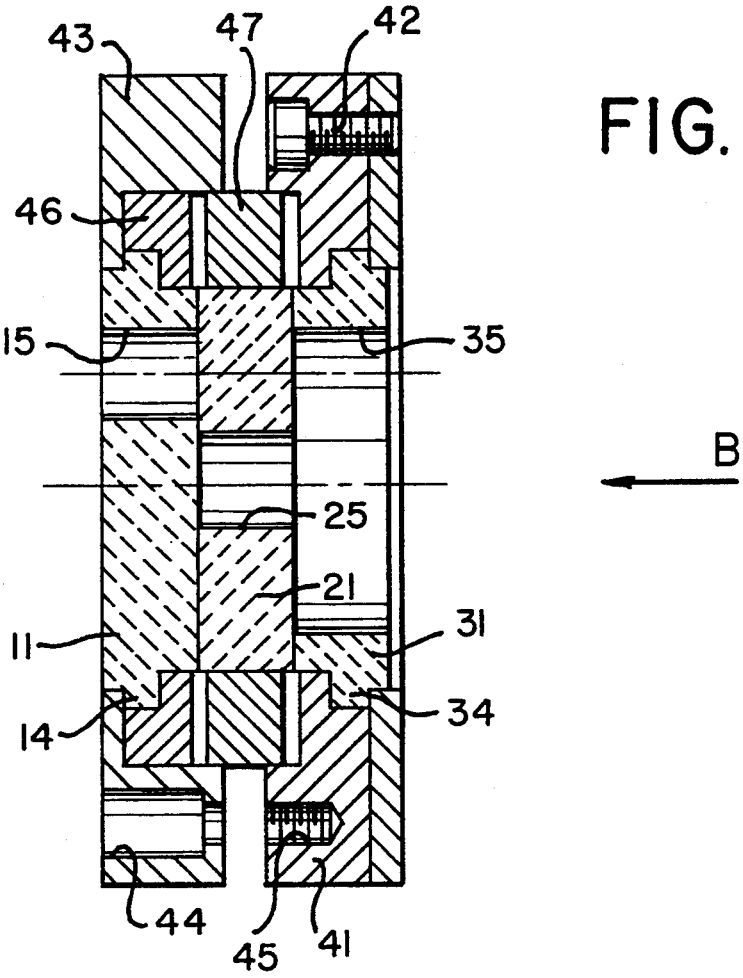
FIG. 2*a* is a sectional view of a valve according to the invention in a first position as seen in the direction of the arrows A—A of FIGS. 1*a*–1*c;*

FIGS. 1a–1c respectively illustrate a generally circular valve plate or element 11, a generally circular valve plate or element 21 and a generally circular valve plate or element 31 forming part of a valve according to the invention. The valve constitutes a rotary slide valve. The valve plates 11, 21, 31 are assumed to be ceramic and the valve is particularly well-suited as a discharge valve for metallurgical vessels. For the purpose of the present description, it is assumed that the valve serves to control the discharge of molten material, e.g., molten metal, from the outlet of a melt-containing vessel into the inlet of a casting mold.

When the valve is in use, the valve plate 11 is adjacent the mold, the valve plate 31 is adjacent the melt-containing vessel and the valve plate 21 is disposed between the valve plates 11 and 31. The valve plate 11 will hereinafter be referred to as the discharge valve plate, the valve plate 21 as the middle valve plate and the valve plate 31 as the inflow valve plate.

The discharge valve plate 11 has a pair of opposed flats 12 and 13 which resemble key faces. The flats 12, 13 allow the discharge valve plate 11 to be fitted and locked in a rotatable carrier or housing component having surfaces complementary to the flats 12, 13. The discharge valve plate 11 is further provided with a collar 14 as well as an oblong through opening or hole 15. The center line of the oblong opening 15 constitutes a segment of a circle. The oblong opening 15, which is not centered on the discharge valve plate 11, extends circumferentially of the discharge valve plate 11 through an angle of approximately 90 degrees.

Like the discharge valve plate 11, the middle valve plate 21 has a pair of opposed flats 22 and 23 resembling key faces. The flats 22, 23 enable the middle valve plate 21 to be engaged by a drive for rotating the middle valve plate 21. The middle valve plate 21 also has a circular through opening or hole 25 which is off-center with respect to the middle valve plate 21. The distance from the center of the middle valve plate 21 to the center of the circular opening 25 equals the distance from the center of the discharge valve plate 11 to the center line of the oblong opening 15.

The inflow valve plate 31 again has two opposed flats 32 and 33 which resemble key faces. The flats 32, 33 permit the inflow valve plate 31 to be held against rotation in a carrier or housing component having surfaces complementary to the flats 32, 33. The inflow valve plate 31 is further provided with a collar 34 as well as an oblong through opening or hole 35. The center line of the oblong opening 35 constitutes a segment of a circle with the same radius as the circle corresponding to the center line of the oblong opening 15. The oblong opening 35 is not centered on the inflow valve plate 31 and the distance from the center of the inflow valve plate 31 to the center line of the oblong opening 35 is the same as the distance from the center of the discharge valve plate 11 to the center line of the oblong opening 15. The oblong opening 35 extends circumferentially of the inflow valve plate 31 through an angle of 180 degrees.

FIGS. 2a, 3a, 4a and 5a show the valve plates 11, 21, 31 in assembled condition so as to form the discharge valve of the invention.

As seen in FIGS. 2a, 3a, 4a and 5a, the inflow valve plate 31 is held against rotation in a first carrier or housing component 41. The first carrier component 41 can be mounted on a melt-containing vessel over the discharge opening thereof by means of screw connections 42.

A second carrier or housing component 43 is connected to the first carrier component 41 for rotation therewith. To this end, the second carrier component 43 is provided with through bores 44 while the first carrier component 41 is provided with threaded bores 45 in alignment with the through bores 44. The through bores 44 and threaded bores 45 allow the two carrier components 41 and 43 to be screwed to one another.

A bearing ring 46 is rotatably mounted in the carrier component 43. The discharge valve plate 11, in turn, is held in the bearing ring 46 so as to be fixed against rotation with respect to the latter. Accordingly, the discharge valve plate 11 is rotatable relative to the carrier components 41, 43 via the bearing ring 46.

A second bearing ring 47 is rotatably disposed in the two carrier components 41, 43 and holds the middle valve plate 21 so that the middle valve plate 21 is unable to rotate relative to the second bearing ring 47. Thus, the middle valve plate 21 is indirectly rotatable in the carrier components 41, 43 through the agency of the second bearing ring 47.

Circumferential gaps exist between the screws which hold the carrier components 41, 43 together and provide room for a drive serving to rotate the middle valve plate 21. By way of example, the outer periphery of the second bearing ring 47 can be provided with teeth which cooperate with a driving pinion located between the carrier components 41, 43.

The collar 14 on the discharge valve plate 11 and the collar 34 on the inflow valve plate 31 help to hold the valve plates 11 and 31 in the carrier 41, 43 and to center the valve plates 11, 21, 31 relative to one another.

Figure 2B:
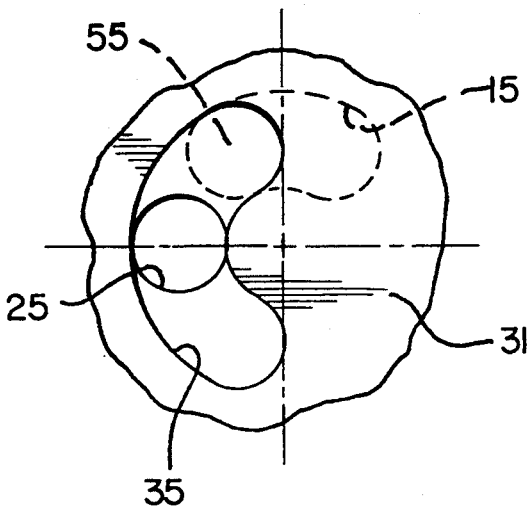
FIG. 2*b* is an elevational view of the openings in the valve plates, as seen in the direction of the arrow B of FIG. 2*a,* in the first position of the valve.

FIG. 2a shows the discharge valve in a first position and FIG. 2b illustrates the corresponding relative positions of the openings 15, 25, 35 in the valve plates 11, 21, 31.

Per FIG. 2b, the opening 25 of the middle valve plate 21 registers with the opening 35 of the inflow valve plate 31. On the other hand, the opening 15 of the discharge valve plate 11 is rotationally offset from the opening 25 of the middle valve plate 21 so that the valve plates 11 and 21 form a closure. The opening 15 of the discharge valve plate 11 and the opening 35 of the inflow valve plate 31 define a region of overlap 55 which serves no function here.

Figure 3A:
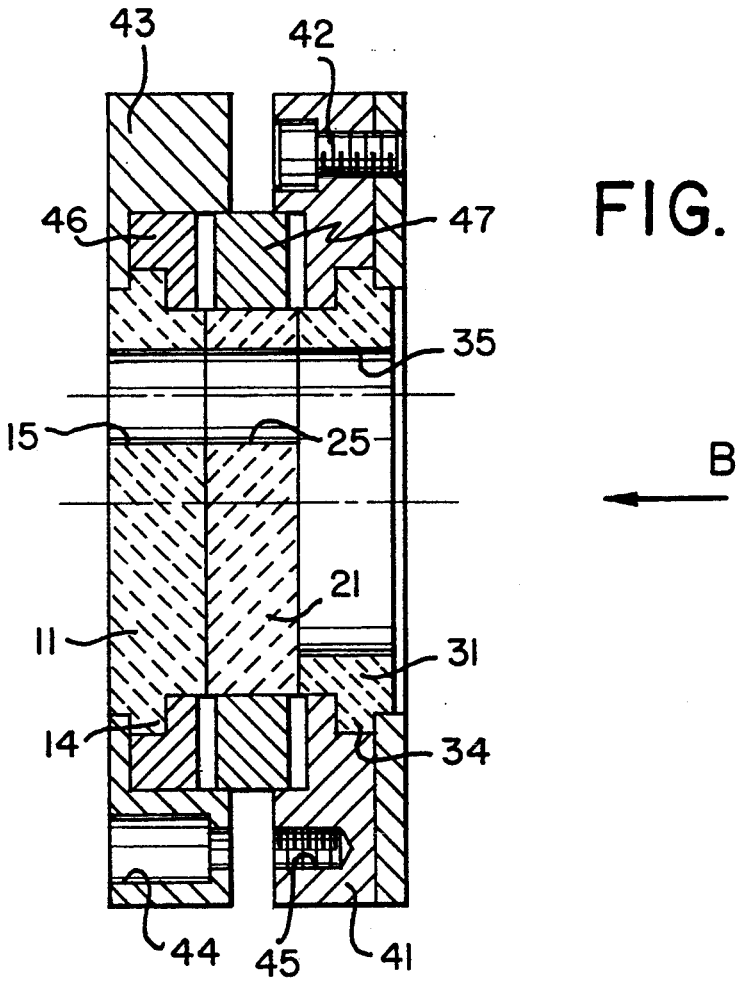
FIG. 3*a* is similar to FIG. 2*a* but shows a second position of the valve.
Figure 3B:
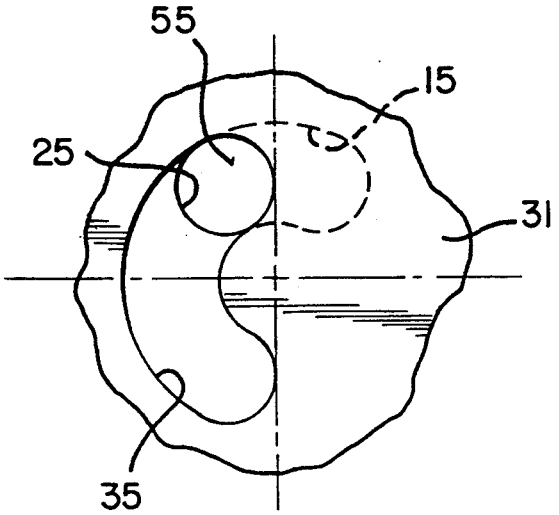
FIG. 3*b* is similar to FIG. 2*b* but illustrates the openings in the second position of the valve.

FIG. 3a illustrates the discharge valve in a second position while FIG. 3b shows the associated relative positions of the openings 15, 25, 35 in the valve plates 11, 21, 31. In FIGS. 3a and 3b, the driven middle valve plate 21 has been rotated approximately 75 degrees from its position in FIGS. 2a and 2b.

Referring to FIG. 3b, the opening 25 of the middle valve plate 21 now coincides with the overlapping region 55 of the openings 15 and 35 in the valve plates 11 and 31. Hence, an axial flow passage through the valve is formed in the latter.

Figure 4A:
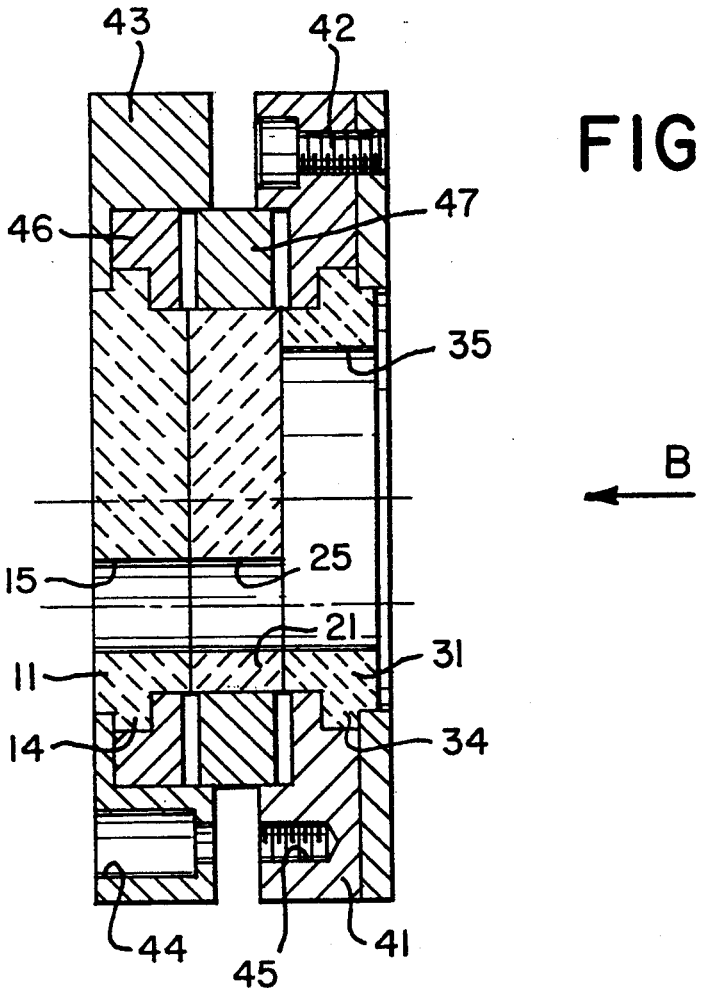
FIG. 4*a* is similar to FIG. 2*a* but shows a third position of the valve.
Figure 4B:
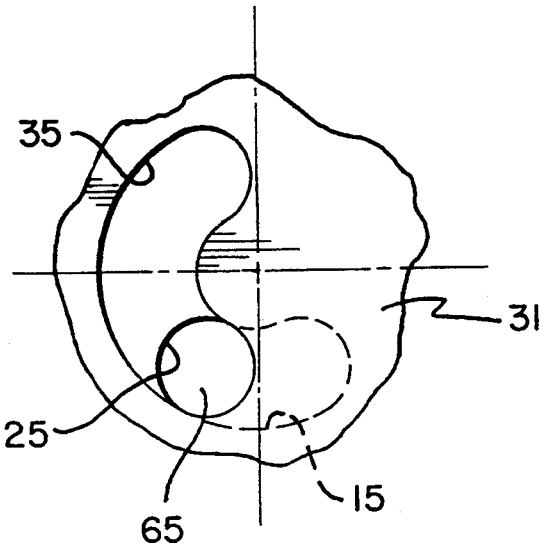
FIG. 4*b* is similar to FIG. 2*b* but illustrates the openings in the third position of the valve.

FIG. 4a shows the discharge valve in a third position and FIG. 4b illustrates the accompanying relative positions of the openings 15, 25, 35 in the valve plates 11, 21, 31. The discharge valve plate 11 is assumed to be in direct frictional contact with a casting mold which was rotated 180 degrees carrying along the discharge valve plate 11 with it so that the discharge valve plate 11 in FIGS. 4a and 4b is rotated 180 degrees from its position in FIGS. 3a and 3b. Furthermore, the middle valve plate 21 in FIGS. 4*a* and 4*b* is rotated approximately 120 degrees from its position in FIGS. 3*a* and 3*b*.

As seen in FIG. 4*b*, the opening 15 of the discharge valve plate 11 and the opening 35 of the inflow valve plate 31 define a new region of overlap 65 which coincides with the opening 25 in the middle valve plate 21. Thus, the flow passage through the valve remains open as the valve plates 11 and 21 rotate.

Figure 5A:
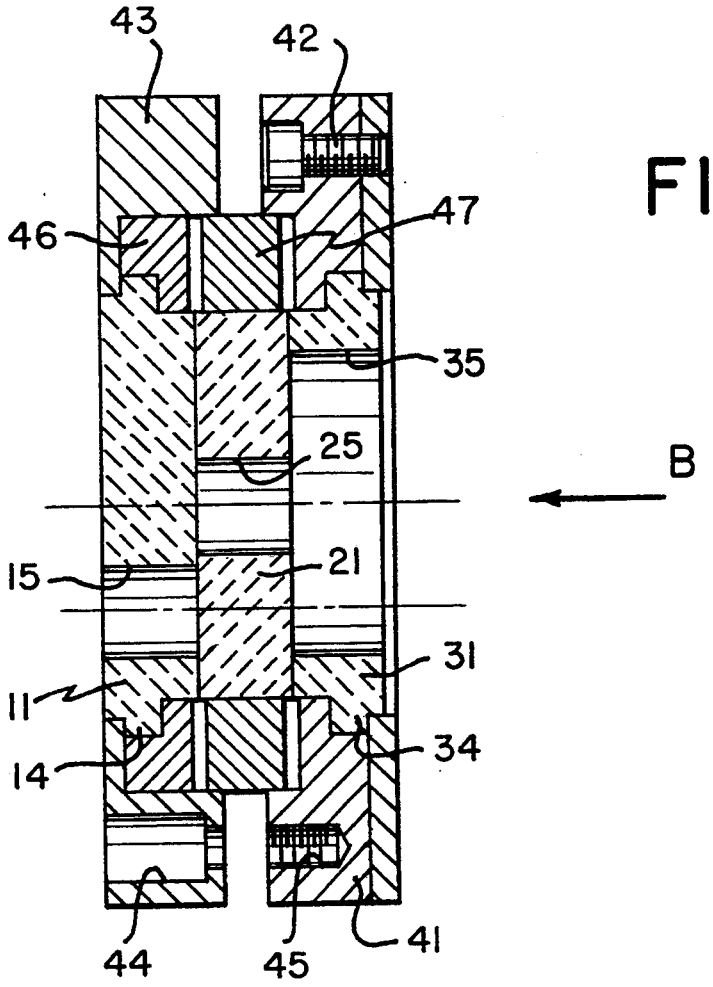
FIG. 5*a* is similar to FIG. 2*a* but shows a fourth position of the valve.
Figure 5B:
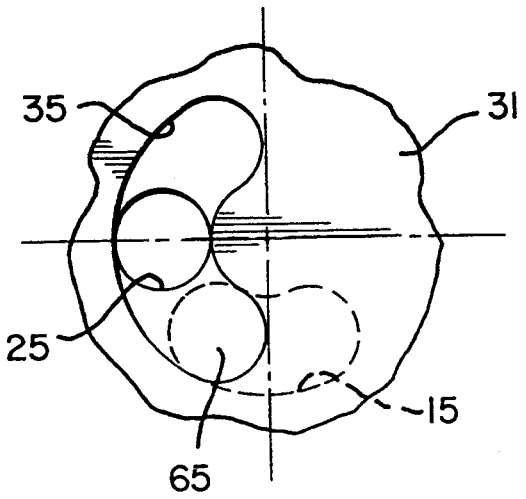
FIG. 5*b* is similar to FIG. 2*b* but illustrates the openings in the fourth position of the valve.

FIG. 5*a* illustrates the discharge valve in a fourth position while FIG. 5*b* shows the corresponding relative positions of the openings 15, 25, 35 in the valve plates 11, 21, 31.

In FIGS. 5*a* and 5*b*, the middle valve plate 21 has been rotated back from the position of FIGS. 4*a* and 4*b*. Per FIG. 5*b*, the opening 25 in the middle valve plate 21 no longer coincides with the overlapping region 65 of the opening 15 in the discharge valve plate 11 and the opening 35 in the inflow valve plate 31. The flow passage through the valve is thus closed when the position of the discharge valve plate 11 remains unchanged. To return to the starting position of FIGS. 2*a* and 2*b*, the discharge valve plate 11 is rotated 180 degrees while the middle valve plate 21 remains in the position of FIG. 5*a*.

FIGS. 6–9 illustrate a mold 83 and a melt-containing vessel 81 having a discharge opening 82. By way of example, the melt-containing vessel 81 can be constituted by a heating furnace.

In FIGS. 6–9, the discharge valve of FIGS. 2*a*, 3*a*, 4*a* and 5*a* is identified generally by the reference numeral 1. The positions of the discharge valve 1 in FIGS. 6–9 respectively correspond to the first, second, third and fourth positions of FIGS. 2*a*, 3*a*, 4*a* and 5*a*.

The discharge valve 1 is mounted on the vessel 81 by means of screws 85 and is positioned so that the inflow valve plate is located adjacent the vessel 81. The discharge valve 1 overlies the discharge opening 82 of the vessel 81 and a seal 84 is interposed between the discharge valve 1 and the vessel 81.

The mold 83 is disposed adjacent the discharge valve plate of the discharge valve 1 and is provided with a shoulder 87 which serves to establish a frictional connection and/or a lock with the discharge valve plate. The mold 83 has a horizontal axis of rotation 88 which coincides with the axes of rotation of the discharge valve plate and the middle valve plate. The mold 83 is provided with an inlet 89, a mold cavity 91 and feeders 90 connecting the inlet 89 with the mold cavity 91.

Figure 6:
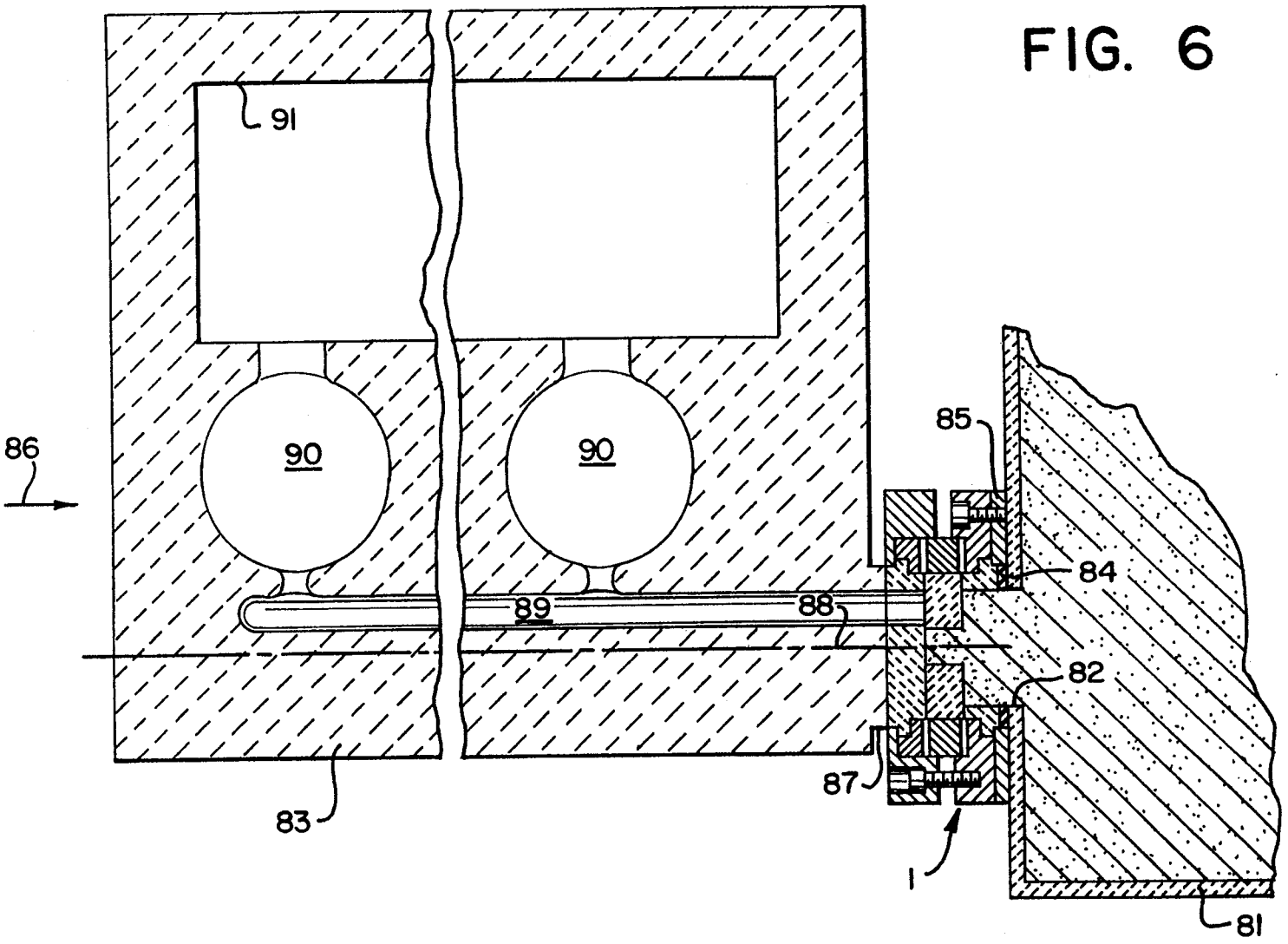
FIG. 6 schematically illustrates a melt-containing vessel and a casting mold joined by the valve of FIGS. 2*a*–5*b* with the valve in its first position.

With reference to FIG. 6, the discharge valve 1 is affixed to the vessel 81 and the mold 83 is then brought into engagement with the discharge valve 1 by moving the mold 83 in the direction of the arrow 86. At this time, the discharge valve 1 is in the first or closed position of FIG. 2*a*. The mold 83 is oriented so that the inlet 89 is in a lower portion of the mold 83. The feeders 90 lie above the inlet 89 with the mold cavity 91 being located above the feeders 90.

Figure 7:
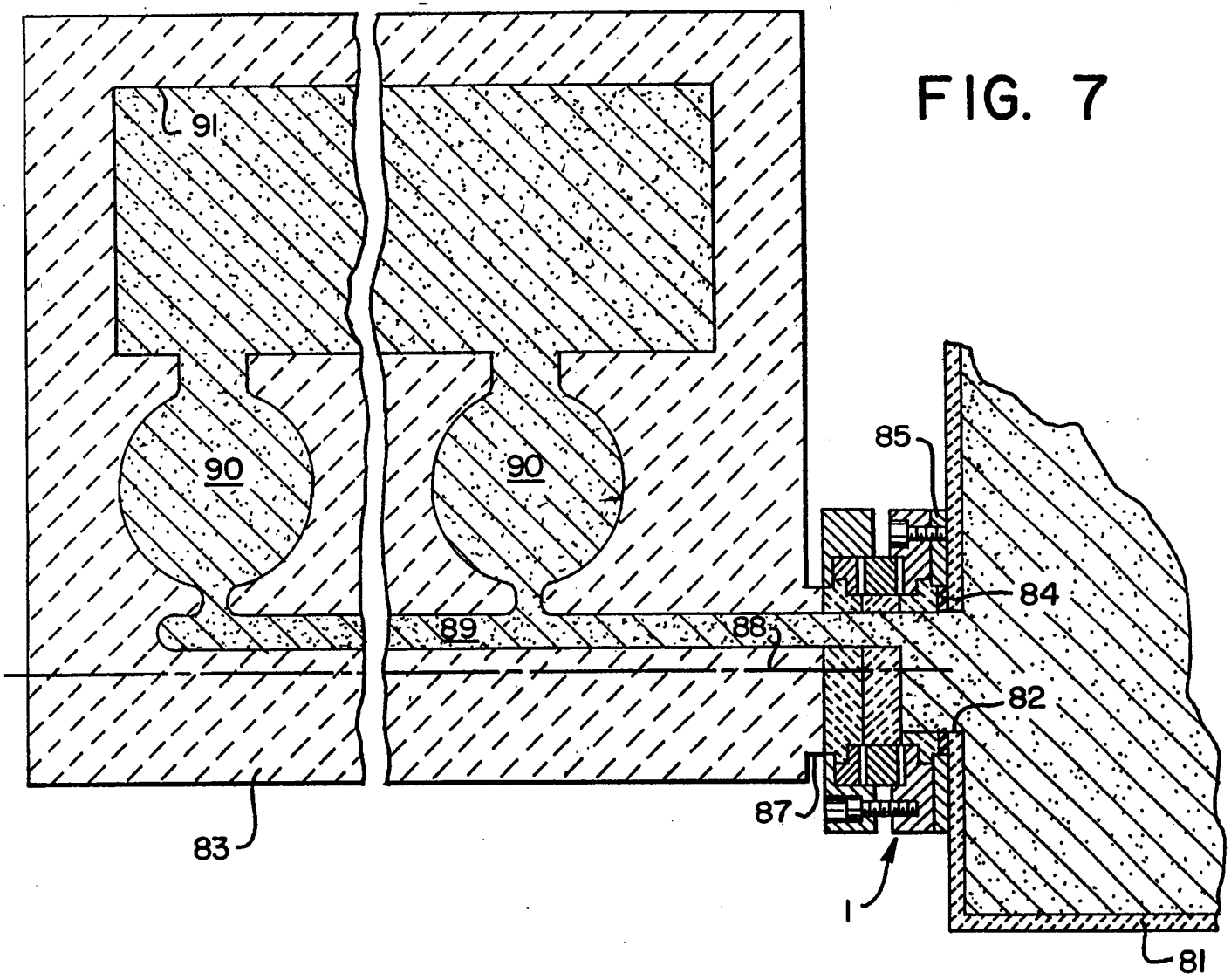
FIG. 7 is similar to FIG. 6 but shows the valve in its second position.

In FIG. 7, the discharge valve 1 has been brought to the second or open position of FIG. 3*a* by rotating the middle discharge plate. Under the action of gravity and the hydrostatic pressure in the vessel 81, the melt in the vessel 81 flows into the inlet 89 of the mold 83 and fills the mold cavity 91 via the feeders 90.

Figure 8:
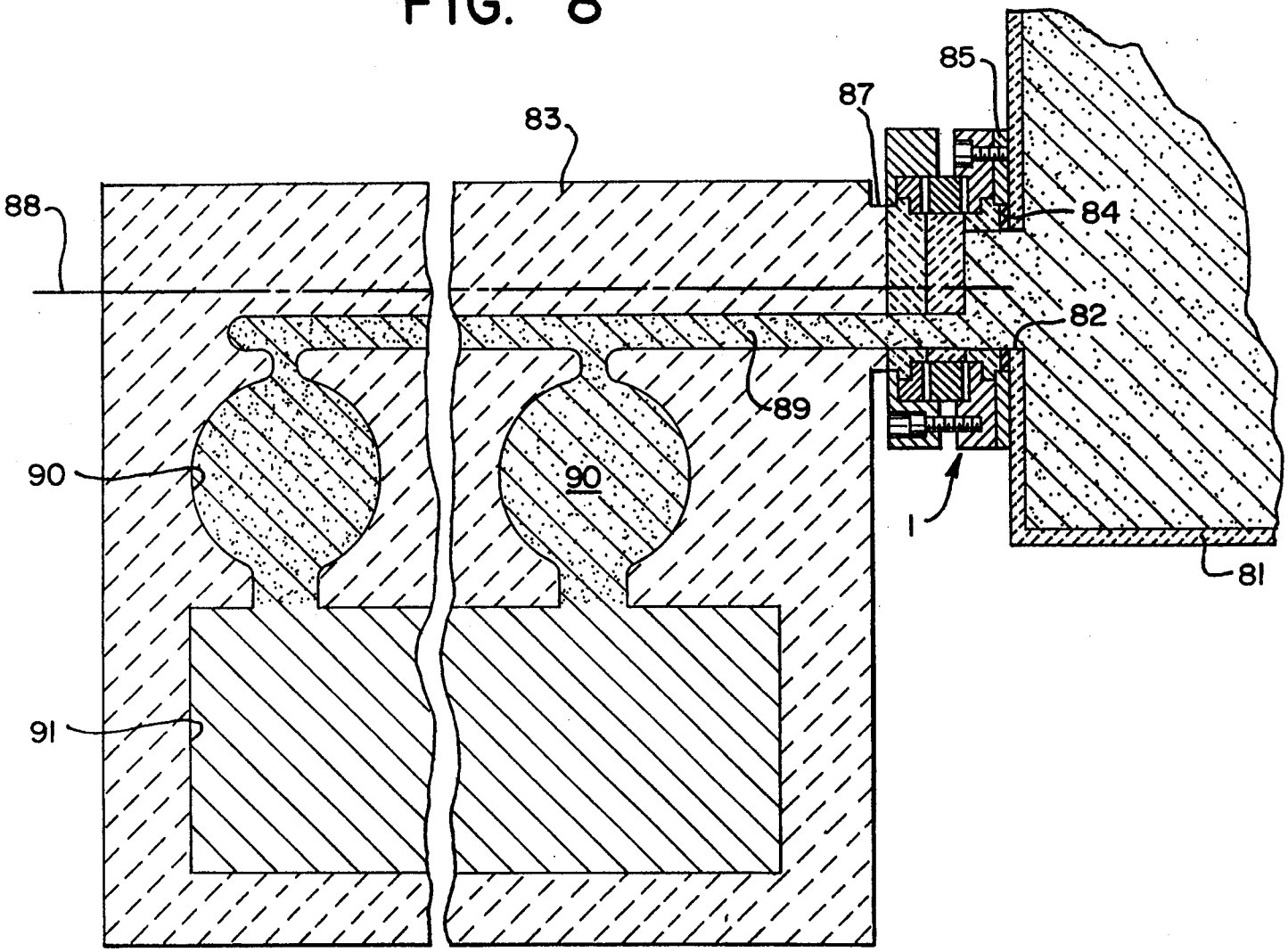
FIG. 8 is similar to FIG. 6 but illustrates the valve in its third position.

Turning to FIG. 8, the mold 83 has been rotated 180 degrees from the position of FIGS. 6 and 7 about its rotational axis 88 and, in turn, has rotated the discharge valve plate through 180 degrees. The discharge valve 1 in FIG. 8 is in the third or open position of FIG. 4*a*. Beginning from the cold end of the mold 83, the molten material in the mold 83 solidifies under the hydrostatic pressure in the vessel 81 which maintains a desired overpressure in the mold 83. Molten material remains in the feeders 90 and the mold inlet 89.

Figure 9:
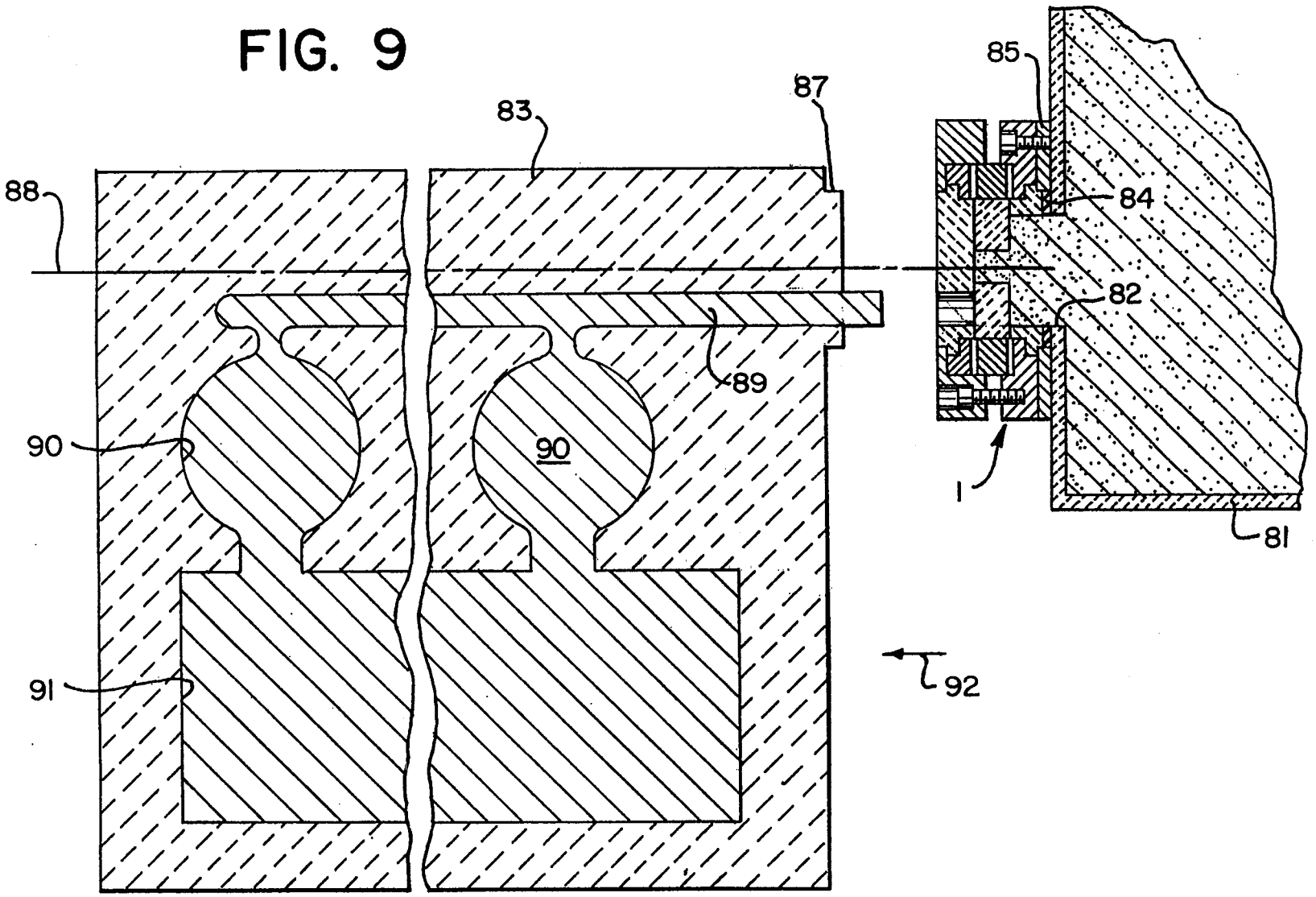
FIG. 9 is similar to FIG. 6 but shows the valve in its fourth position.

In FIG. 9, casting and solidification have been completed and the discharge valve 1 has been brought into the fourth or closed position of FIG. 5*a*. All of the molten material in the mold 83, including that in the feeders 90 and the mold inlet 89, has solidified. The mold 83 is now removed from the vessel 81 by shifting the mold 83 parallel to its rotational axis 88 as indicated by the arrow 92.

Once the mold 83 has been separated from the vessel 81, the discharge valve 1 can be returned to the first or closed position of FIGS. 2*a* and 6. A new mold can then be transported to the vessel 81.

Various modifications can be made within the meaning and range of equivalence of the appended claims.

I claim:

1. A valve, particularly a discharge valve for metallurgical vessels, comprising a plurality of valve elements including two which are shiftable relative to one another, each of said valve elements having an opening for the passage of fluid therethrough, and a selected valve element of said plurality being movable between a first position and a second position, said openings being arranged so that, in each of said positions, the openings of all valve elements can be in register and, alternatively, at least two openings can be out of register.

2. The valve of claim 1 for controlling the discharge of fluid from an outlet of a first vessel into a movable inlet of a second vessel, wherein said selected valve element is movable between said positions in at least approximate synchronism with the inlet.

3. The valve of claim 1, further comprising a carrier for said valve elements.

4. The valve of claim 1, wherein said two relatively shiftable valve elements are rotatable relative to one another.

5. The valve of claim 1, wherein said valve elements are plate-like.

6. The valve of claim 1, wherein each of said openings is off-center in the respective valve element.

7. The valve of claim 1, wherein said valve elements include a valve element which is disposed adjacent to said selected valve element and is arranged to be controllably driven.

8. The valve of claim 1, wherein said valve elements include a pair of valve elements on one side of said selected valve element, at least one valve element of said pair being arranged to be controllably driven.

9. The valve of claim 8, further comprising a carrier for said valve elements, said one valve element of said pair being located between said selected valve element and the other valve element of said pair, and said other valve element of said pair being fixed in said carrier.

10. The valve of claim 8, wherein a predetermined valve element of said pair is located between said selected valve element and the other valve element of said pair, the opening of said predetermined valve element extending circumferentially through an angle smaller than that for the opening of at least one of said selected valve element and said other valve element of said pair.

11. The valve of claim 10, wherein said opening of said predetermined valve element extends circumferentially through an angle smaller than that for the opening of said selected valve element and that for the opening of said other valve element of said pair.

12. The valve of claim 10, wherein said opening of said predetermined valve element is substantially circular.

13. The valve of claim 8, wherein the opening of said selected valve element and the opening of a preselected valve element of said pair are in register in said first and second positions of said selected valve element.

14. The valve of claim 13, wherein said opening of said selected valve element and said opening of said preselected valve element of said pair are in register in all relative positions of said selected valve element and said preselected valve element of said pair.

15. The valve of claim 1, wherein said valve elements comprise ceramic.

16. The valve of claim 1, wherein each of said valve elements is generally circular and is provided with at least one flat for engaging the respective valve element.

17. The valve of claim 1, wherein at least one of said valve elements is provided with means for centering said one valve element relative to another of said valve elements.

18. The valve of claim 17, wherein said centering means comprises a collar on said one valve element.

* * * * *